US006254455B1

(12) United States Patent
Irvine et al.

(10) Patent No.: US 6,254,455 B1
(45) Date of Patent: Jul. 3, 2001

(54) JIG FOR USE IN SHARPENING CUTTING IMPLEMENT FOR USE IN WOOD TURNING

(76) Inventors: Michael Irvine, 775 Forest Road, Peakhurst, NSW, 2210; John Arthur Crawford, 18 Terry Street, Blakehurst, NSW, 2221, both of (AU)

( * ) Notice: Subject to any disclaimer, the term of this patent is extended or adjusted under 35 U.S.C. 154(b) by 0 days.

(21) Appl. No.: 09/543,226

(22) Filed: Apr. 5, 2000

(30) Foreign Application Priority Data

Apr. 6, 1999 (AU) ..... PP9593

(51) Int. Cl.[7] ..... B24B 1/00
(52) U.S. Cl. ..... 451/28; 451/376; 451/378
(58) Field of Search ..... 451/371, 374, 451/375, 376, 377, 393, 394, 48, 45

(56) References Cited

U.S. PATENT DOCUMENTS 3,482,325 * 12/1969 Mitchell ..... 33/185
4,142,332 * 3/1979 Clarke ..... 51/125
4,483,104 * 11/1984 Welliver ..... 51/219 R
4,547,999 * 10/1985 Reiling et al. ..... 51/219 R

* cited by examiner

*Primary Examiner*—Joseph J. Hail, III
*Assistant Examiner*—Dung Van Nguyen
(74) *Attorney, Agent, or Firm*—Harrison & Egbert

(57) ABSTRACT

A jig (10) for use in sharpening a cutting implement used in wood turning including a tubular body or housing (12) being mountable nearby a grinder. A tool holder (11) is located by and guided within the housing (12) so as to be pivotable about a longitudinal axis of the housing and slidable along that axis. Part of the tool passes through the housing (12) and holder (11), being attached to holder (11) so as to present a tip of the tool toward the grinder. The tool holder (11) further has a guide boss (14) engageable with a guide surface (13) on the housing such that throughout engagement a correlation exists between linear movement of the tool along the longitudinal axis and pivotal movement of the tool about the longitudinal axis, so as to enable a desired, controlled interaction between the tip of the tool and the grinder.

7 Claims, 5 Drawing Sheets

JIG FOR USE IN SHARPENING CUTTING IMPLEMENT FOR USE IN WOOD TURNING

FIELD OF THE INVENTION

The following invention relates to a jig for use in sharpening cutting implements, typically for use in wood turning and/or wood carving. More particularly, though not exclusively, the invention relates to a jig for supporting and guiding a spindle and/or detail gouge enabling interaction of the gouge with a grinding wheel so as to provide a desirable fingernail shape at the sharpened end of the gouge. The invention also relates to such a jig which can also be used to sharpen a gouge such as a bowl gouge, roughing gouge, Euro spindle gouge, carving chisels and carving gouge.

BACKGROUND ART

It is known to manually support a gouge upon a support bar in front of a grinding wheel and to move the guouge using a fanning action during sharpening. This provides a less than ideal profile at the sharpened end of the gouge. In order to provide the desired fingernail shape at the end of the gouge, a "rotate and push method" ought to be adopted. That is, the gouge ought to be rotated only about its longitudinal axis while being pushed along that axis toward the grinding wheel. A fingernail profile so produced provides a desirable cutting effect when engaged with a piece of wood being turned upon a lathe.

It is known to perform the rotate and push method manually. However, it takes a skilled operator to achieve the desired result.

It is the object of the present invention to overcome or substantially ameliorate the above disadvantages and/or more generally to provide a jig for use in sharpening a cutting implement such as a gouge for use in wood turning and/or wood carving.

SUMMARY OF THE INVENTION

There is disclosed herein a jig including:

a tubular housing having opposed ends and a guide surface, the housing being mountable nearby a grinder, a tool holder located by and guided within the housing so as to be pivotable about a longitudinal axis of the housing and slidable along the longitudinal axis, the tool holder having attachment means to secure a tool thereto such that part of the tool passes through the housing so as to present a tip of the tool toward the grinder, the tool holder further having a guide boss engageable with the guide surface such that throughout engagement a correlation exists between linear movement of the tool along the longitudinal axis and pivotal movement of the tool about the longitudinal axis, so as to enable a desired, controlled interaction between the tip of the tool and the grinder.

Preferably the grinder is a grinding wheel and the housing is pivotally mounted nearby the grinding wheel about an axis which is parallel with the rotational axis of the grinding wheel.

Preferably the guide surface of the tubular housing is annular and is at one of the opposed ends thereof.

Preferably the housing has two annular guide surfaces, one at each opposed end thereof.

Preferably one of the guide surfaces is planar, being in a plane normal to the longitudinal axis of the housing.

Preferably the other guide surface is at an acute angle with respect to the longitudinal axis of the housing. Alternatively, this other guide surface can be contoured, curved, staggered, stepped or otherwise formed.

Preferably the attachment means of the tool holder includes one or more threaded apertures through which bolts can be received, such bolts extend radially of the longitudinal axis of the housing and are tightenable upon the tool.

Where two guide surfaces are provided, two guide bosses are provided, each boss being engageable, one at a time, with a respective one of said guide surfaces.

Typically, the tool is a gouge for use in wood turning or wood carving.

Where the gouge is a spindle and/or detail gouge, it can be sharpened using the above jig by engagement of one of the guide bosses along said acutely angled guide surface.

Where the gouge is a bowl gouge, Euro spindle gouge, roughing gouge, carving chisel or carving gouge, the other of the guide bosses is typically engaged with the other guide surface; that is, the guide surface in a plane normal to the longitudinal axis of the housing. A rotational action only is required when sharpening a bowl gouge whereas a combined rotational and longitudinal motion is required when sharpening a spindle and/or detail gouge.

There is further disclosed herein a method of sharpening a gouge, the method including the steps of:

attaching the gouge to the tool holder of the above-disclosed jig such that the gouge passes through the housing with an end of the gouge presented to the grinder, pivoting the gouge about its longitudinal axis such that the tool holder pivots and slides linearly within the tubular housing whilst maintaining contact of the guide boss with the guide surface.

BRIEF DESCRIPTION OF THE DRAWINGS

A preferred form of the present invention will now be described by way of example with reference to the accompanying drawings.

DETAILED DESCRIPTION OF THE INVENTION

Figure 1:
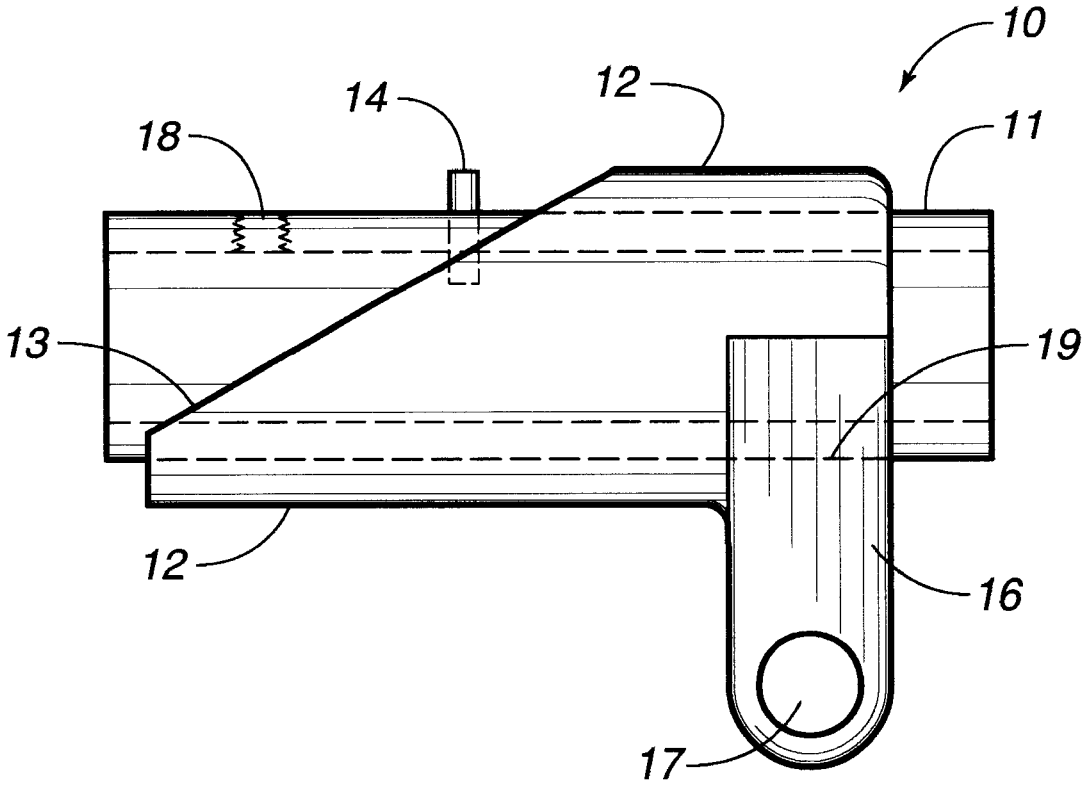
FIG. 1 is a schematic elevational view of a jig for use in sharpening cutting implements for use in wood tuning.
Figure 2:
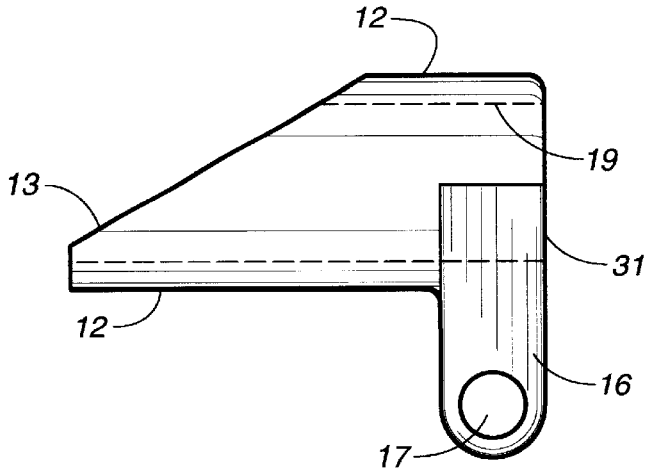
FIG. 2 is a schematic elevational view of a housing, forming part of the jig of FIG. 1
Figure 3:
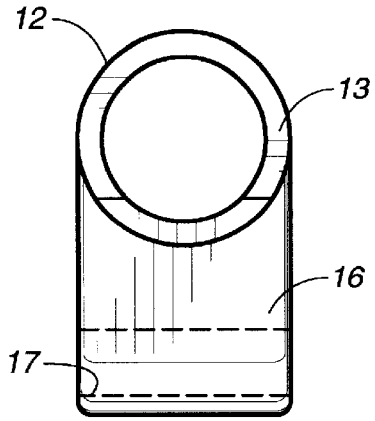
FIG. 3 is a schematic end of elevational view of the housing of FIG. 1
Figure 4:
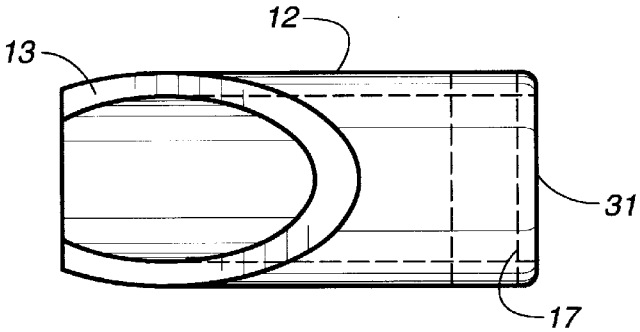
FIG. 4 is a schematic plan view of the housing of FIGS. 2 and 3
Figure 5:
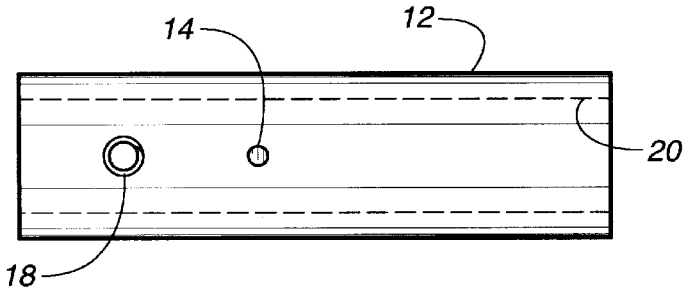
FIG. 5 is a schematic plan view of a tool holder, forming part of the jig of FIGS. 1 to 3

In FIG. 1 of the accompanying drawings, there is schematically depicted a jig 10 for use in sharpening a gouge of the type used in wood turning.

The jig 10 includes a cast metallic housing 12 which includes a leg 16 by which the housing 12 can be pivotally mounted by means of an axle passing through pivot hole 17. The housing 12 has a passage 19 extending therethrough which has a circular cross-section. As an alternative to casting the housing 12 integrally with the leg 16, two separate pieces of metal pipe can be welded together to provide the tubular body and pivot hole 17.

Located within the housing 12 and adapted to slide smoothly therein is a tubular tool holder 11. Tool holder 11 is typically formed from a length of metallic pipe. The outer diameter of the tool holder 11 is to be slightly less than the inner diameter of the passage 19 passing through the housing 12 so as to enable smooth, yet guided, free movement of the tool holder 11 within the housing 12.

At the left hand end of the housing 12, there is provided an angled guide surface 13. The angle of the guide surface with respect to the longitudinal axis A of the housing 12 is typically in the range of 30° to 60° but is more typically 40°. As an alternative to a fixed angle, the surface 13 might be curved, contoured, stepped or otherwise formed, depending on the type of tool being sharpened or the desired sharpening profile to be achieved at the tool tip. At the other, right hand end of housing 12, there is another guide surface 31, which in this instance resides in a plane that is normal to the longitudinal axis A of the housing 12.

The tool holder 11 includes a boss 14. The boss 14 is adapted to ride against the angled guide surface 13 when the tool holder 11 is rotated about axis A. That is, so long as the boss 14 is maintained in contact with the guide surface 13 when the tool holder 11 is pivoted about axis A, the tool holder 11 will be caused to travel along axis A in a defined and controlled manner. In this way, the position of the tool along axis A is aligned with the pivotal orientation of the holder about axis A.

Figure 6:
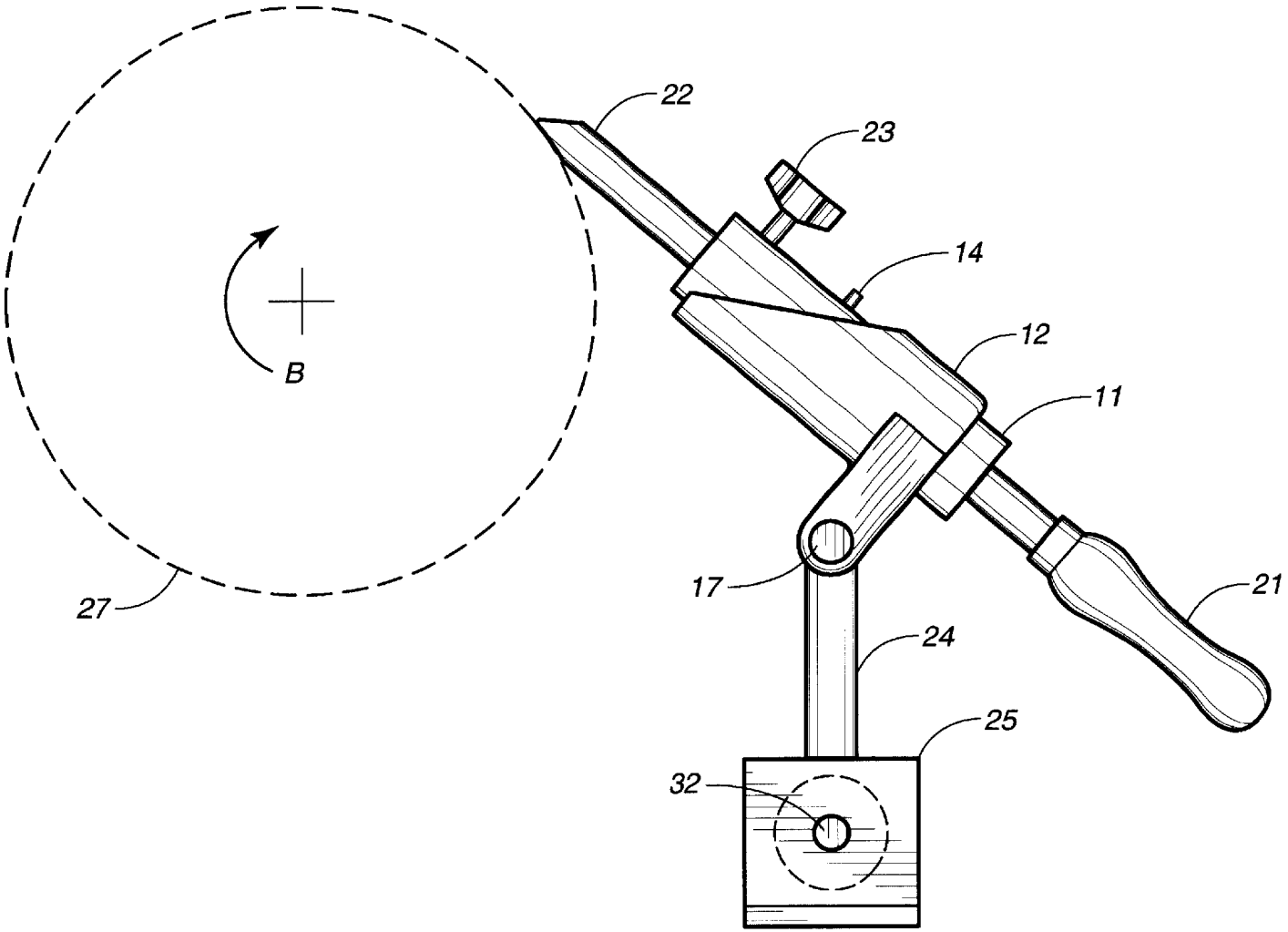
FIG. 6 is a schematic elevational view of the jig of FIG. 1 mounted upon a post alongside a grinding wheel, the jig supporting a tool being sharpened against the grinding wheel FIG. 7(*a*) is a schematic plan view of a spindle and/or detail gouge FIG. 7(*b*) is a schematic side elevational view of the gouge of FIG. 7(*a*)

The tool holder 11 includes a pair of internally threaded apertures 18, each of which receives a bolt 23 (FIG. 6) which bears down upon the shaft or blade of a gouge 22. As shown in FIG. 6, a gouge 22 includes a handle 21. The blade of the gouge 22 passes through a passage 20 of the tool holder 11 within which it is retained by bolts 23.

Also as shown in FIG. 6, the housing 12 is pivotally mounted upon a post 24, the base 25 of which is typically secured to a workbench top. Also upon this workbench would be a grinding wheel 27 against which the tip of the tool shaft 22 is sharpened. The grinding wheel 27 is typically driven by an electric motor so as to rotate about axis B.

Figure 7A:
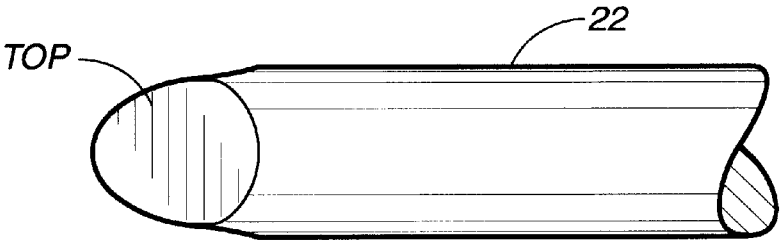
Figure 7B:
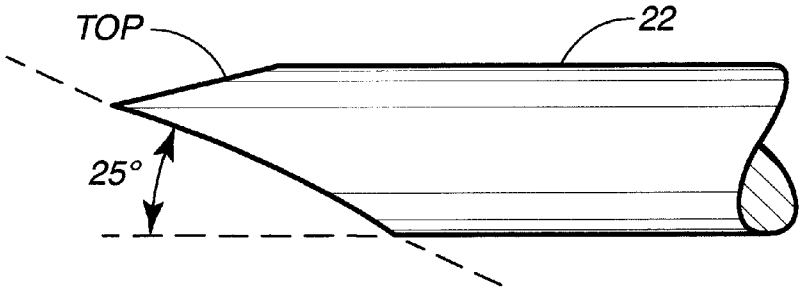
Figure 10:
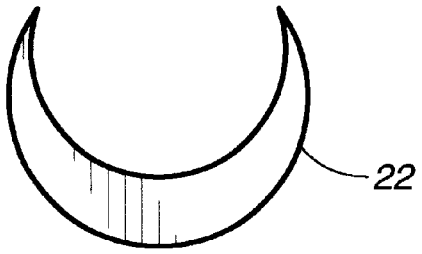
FIG. 10 is a schematic end elevational view of a bowl gouge
Figure 11:
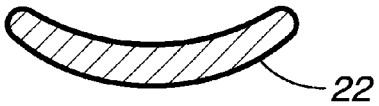
FIGS. 11, 12 and 13 are schematic cross-sectional end elevational views of a number of different gouge sometimes known as Euro spindle gouges or roughing gouges.
Figure 12:
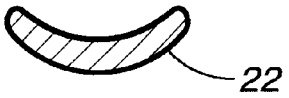
Figure 13:
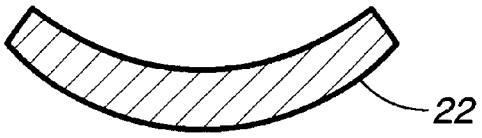

FIGS. 7(*a*), 7(*b*) and 9 show the desired "fingernail" contour at the sharpened end of a spindle and/or detail gouge produced by a "rotate and push method" achieved by use of the jig 10 with forward boss 14 maintained in contact with guide surface 13.

Figure 8:
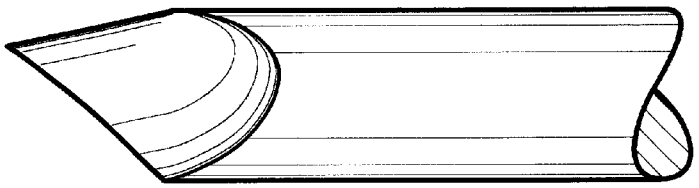
FIG. 8 is a schematic side elevational view of a spindle and/or detail gouge having an undesirable contour as produced by a fanning action upon a grinding wheel
Figure 9:
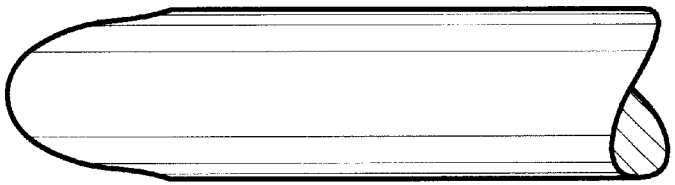
FIG. 9 is a schematic plan view of a spindle and/or detail gouge having a desirable "fingernail" contour as produced by the jig as disclosed herein

FIG. 8 on the other hand shows an undesirable contour formed at the end of a sharpened spindle and/or detail gouge using a manual "fanning action".

To produce the "fingernail" contour, the following procedure can be adopted.

Firstly it should be ensured that the vertical post 24 is parallel with the sides of the grinding wheel 11.

To determine the shape of the desired fingernail gouge, the top cutting edge thereof is first placed gently on the side of the grinding stone. A small amount of material is then ground away off both cutting edges. This will achieve the shape to which grinding will be made.

With the grinder not running, the gouge blade 22 is clamped into the tool holder 11 by means of bolt 23. A desired length of the blade 22 should protrude from the front end of the tool holder. The handle 21 of the gouge should then be maneuverd until the tip of the blade 22 touches the grinding wheel 27. Then looking from the side, all the hollow ground bevel of the tool should be in contact with the grinding stone. If not, the locking bolt 32 should be slackened to enable the post 24 to be pivoted forward or back until the bevel is in contact with the stone. Rotation of the gouge about axis A can be performed by manipulating handle 21. At the same time, if the forward boss 14 should be maintained in contact with the guide surface 13. Rotating the gouge to the right and left projects the gouge blade 22 forward and backwards to give the desired sharpening effect. Of course, at this time, the grinding wheel 27 is rotating. There is no need to force the jig 10 in any way, except to maintain contact between boss 14 and guide surface 13. A forwards and backwards pivoting motion should be maintained until the operator has removed the flats which define the required shape.

It should be appreciated that modifications and alterations obvious to those skilled in the art are not to be considered as beyond the scope of the present invention. For example, instead of providing guide surfaces at opposed ends of housing 12, appropriate slots might be provided in the housing. The slots might pass the whole way through the housing sidewall, or might be formed in the internal surface thereof.

I claim:

1. A jig apparatus for use in sharpening woodworking gouges, carving chiesels and carving gouges comprising:

a grinder;

a tubular housing having opposed ends and a guide surface, said tubular housing having a longitudinal axis, said guide surface being at an acute angle with respect to said longitudinal axis, said housing being movable adjacent said grinder;

a tool; and a tool holder located by and guided within said housing so as to be pivotable about said longitudinal axis of said housing and slidable along said longitudinal axis, said tool holder having an attachment means for securing said tool thereto such that a part of said tool passes through said housing so as to present a tip of said tool toward said grinder, said tool holder further having a guide boss engagable with said guide surface such that throughout engagement a correspondence exists between linear movement of said tool along said longitudinal axis and a pivotal movement of said tool about said longitudinal axis so as to cause a desired controlled interaction between said tip of said tool and said grinder.

2. The jig apparatus of claim 1 wherein said grinder is a grinding wheel and said housing is pivotally mounted nearby said grinding wheel about an axis which is parallel to a rotational axis of said grinding wheel.

3. The jig apparatus of claim 1 wherein the housing has two annular guide surfaces, each of respective opposed ends thereof.

4. The jig apparatus of claim 3 wherein one of said guide surfaces is planer, being in a plane normal to the longitudinal axis of the housing.

5. The jig apparatus of claim 4 wherein the other of said guide surfaces is contoured.

6. The jig apparatus of claim 1 wherein the attachment means of said tool holder includes at least one threaded aperture through which a bolt can be received, the bolt extending radially of said longitudinal axis of said housing and being tightenable upon said tool.

7. A method of sharpening a gouge by using a jig apparatus having a grinder and a tubular housing and a tool holder, the tubular housing having a longitudinal axis with a guide surface of an acute angle with respect to the longitudinal axis, the tool holder being guidable within the housing so as to be pivotable and slidable about the longitudinal axis of the housing, the tool holder having a guide boss engagable with the guide surface, the method comprising the steps of:

attaching the gouge to the tool holder such that the gouge passes through the housing with an end of the gouge presented to the grinder; and pivoting the gouge about the longitudinal axis thereof such that the tool holder pivots and slides linearly within the tubular housing while maintaining contact of said guide boss with said guide surface.

* * * * *